United States Patent [19]

Grace, Jr. et al.

[11] 4,006,681

[45] Feb. 8, 1977

[54] ENDLESS TYPE FLEXIBLE SUPPORT BELT FOR A HIGH SPEED PRINTER

[75] Inventors: Louis Grace, Jr.; Richard L. Grace, both of Memphis, Mich.

[73] Assignee: Grace Engineering, Inc., Memphis, Mich.

[22] Filed: July 9, 1975

[21] Appl. No.: 594,211

[52] U.S. Cl. ..... 101/111

[51] Int. Cl.[2] ..... B41J 1/20

[58] Field of Search ..... 101/93.13, 93.14, 111, 101/105

[56] References Cited

UNITED STATES PATENTS

| | | | |
|---|---|---|---|
| 3,605,613 | 9/1971 | DePuy et al. | 101/111 |
| 3,683,802 | 8/1972 | Hepner et al. | 101/111 |
| 3,791,292 | 2/1974 | Sonderstrom et al. | 101/111 |
| 3,845,711 | 11/1974 | Helms | 101/111 |

OTHER PUBLICATIONS

Kearney et al., Western Electric Tech. Digest No. 28, Oct. 1972, p. 23, "Endless Carrier Printers".

*Primary Examiner*—Edward M. Coven
*Attorney, Agent, or Firm*—Cullen, Settle, Sloman & Cantor

[57] ABSTRACT

An endless flexible print belt or character support for a printing apparatus which includes a writing medium and a striking arrangement for applying mechanical strike pulses to the writing medium, with the print belt or character support being actuated or driven so as to advance with respect to the writing medium. According to the present invention, the print belt or character support has a plurality of elongated relatively hard type bearing segments located in a predetermined side by side relationship and in close proximity to adjacent segments, with the axis of the segments being parallel. A series of reinforcing cords extend laterally across and engage the segments to provide reinforcement therefor. An elastic bonding or encapsulating material is disposed between the segments and around the cords to lock the type bearing segments in the predetermined position. The elastic encapsulating material serves to deaden or dampen the noise generated while the printing apparatus is in operation and permits the support or belt to flex as it traverses, as an example, the pair of rotating pulleys of the apparatus. In one form, the endless flexible print belt has the segments in side by side relationship throughout 360°, with the reinforcing cords in tension and adapted to hold the belt on the pulleys.

13 Claims, 18 Drawing Figures

FIG. 2
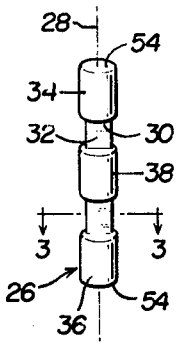
FIG. 3
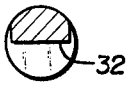
FIG. 1
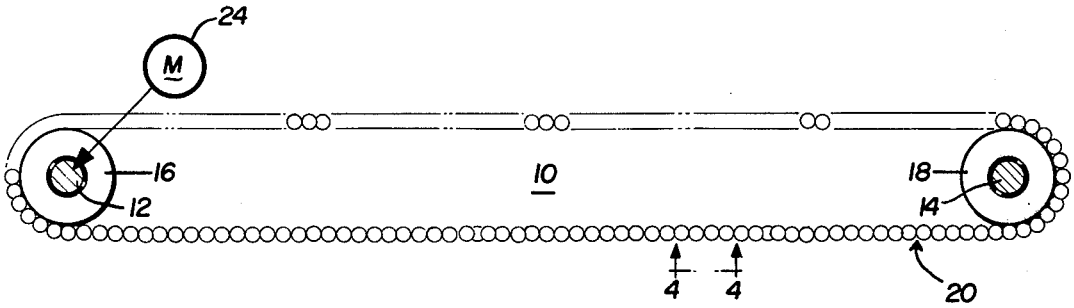
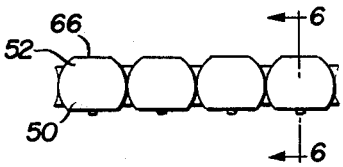
FIG. 5
FIG. 4
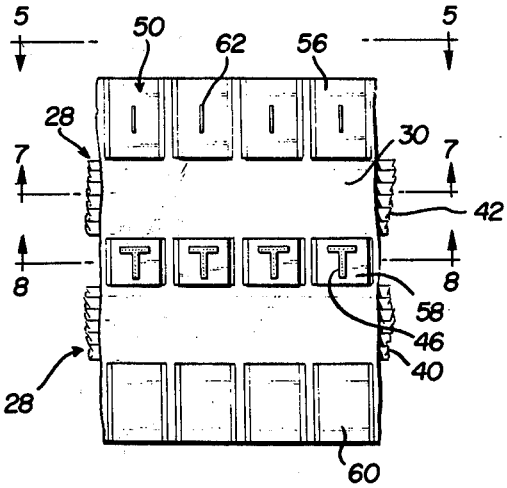
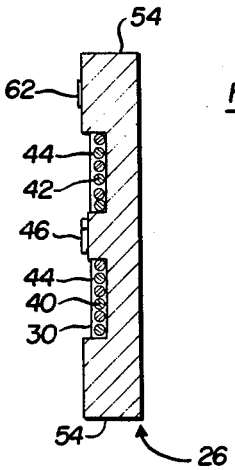
FIG. 6
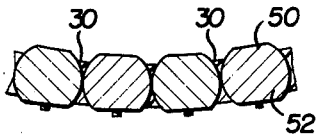
FIG. 8
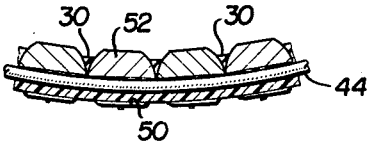
FIG. 7

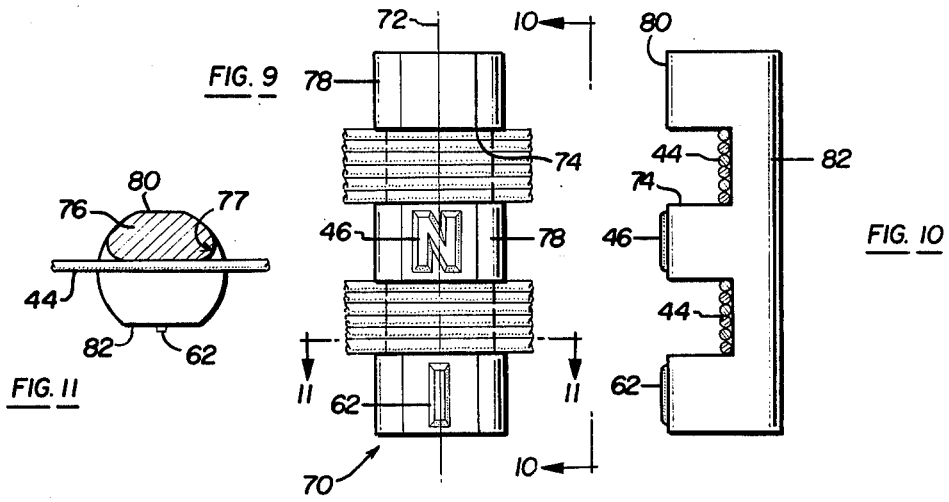
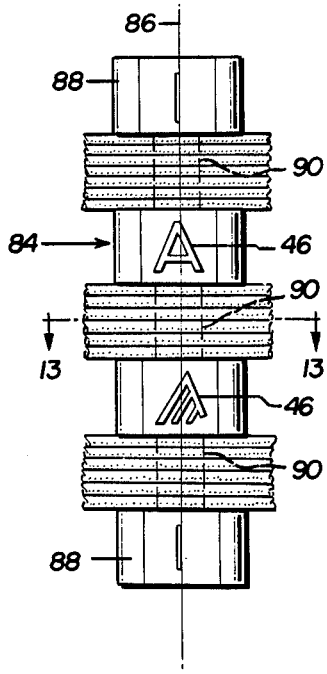
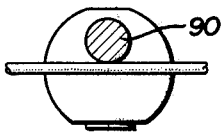
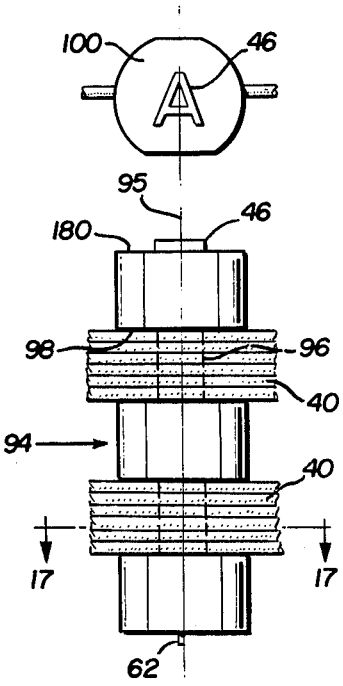
FIG. 14
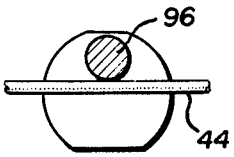
FIG. 17
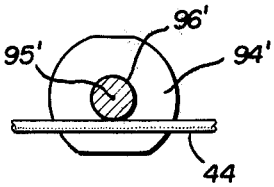
FIG. 18
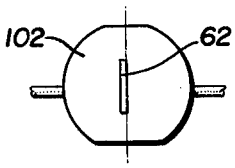
FIG. 16

ENDLESS TYPE FLEXIBLE SUPPORT BELT FOR A HIGH SPEED PRINTER

BACKGROUND OF THE PRESENT INVENTION

1. Field of the Invention

The present invention relates to an improved endless flexible print belt intended for "on-the-fly" printing. More particularly, the present invention relates to a character support for a printing apparatus in which printing impressions are formed by impacting the character support against a record or writing medium under the control of hammers.

The invention disclosed herein may take the form of an endless flexible print belt adapted for use with band printers; or may take the form of an annular band which is applied and secured to a cylindrical plastic or metal element to form a drum for use with drum printers; or may take the form of an annular band which is applied and secured to a plastic or metal part of generally circular configuration to form a print wheel for use with wheel printers.

2. Description of the Prior Art

It is common in the industry to utilize an endless metallic or stainless steel print belt having the characters and timing marks affixed thereon by either mechanical, chemical or electrical generation as is well known in the art. Such metal belts, when the ends are welded together, may warp or be out of line when in use thus rendering them ineffective. In some non-metallic belts, the character bearing elements or segments are affixed to the flexible belts by welding, gluing or by mechanical bonding.

The prior art metallic belts are expensive to produce since it is difficult to technically control the shape and contour of the belt. In printers manufactured today, the belt is stretched over two pulleys, one pulley being driven causing the metallic belt to move at a rather high velocity. Every time a given segment or portion of the metallic belt passes over a pulley on one end, severe internal stresses are induced or generated within the belt itself resulting in metal fatigue thus reducing the useful life of the belt. It is well known that the life of the metallic belt can be increased by maintaining the hardness of the metallic belt relatively soft, as an example, by utilizing a metal having a Rockwell hardness in the range of 40 to 45. While such soft metal belt may reduce belt fatigue, thereby tending to extend the life of same, another problem results. When paper, which is abrasive, is moved over the characters on the belt, it tends to abrade or wear the characters very rapidly thus reducing the life of the belt when softer metallic materials are used.

It has also been found that the endless metallic belts now utilized are designed for pulleys having an outside diameter of 5 inches or more. As the pulley size decreases the internal stresses within the driven belt increase very rapidly. This means that pulleys smaller than 5 inches outside diameter are not economically sound. This results in the equipment manufacturer utilizing rather large bulky heads and cabinets to encompass the machine. Therefore, the metallic print belts now utilized in the art have several problems which limit the useful life of the belt itself and also the life of the characters on the belt regardless of how the characters are applied to the belt. Thus whatever solutions have been adopted heretofore to extend the life of the metal belt per se or of the characters thereon, have not been economically or technically sound. This invention solves such problems.

United States patents disclosing endless belts are as follows: Helms, U.S. Pat. No. 3,845,711, dated Nov. 5, 1974; Deproux, U.S. Pat. No. 3,838,765, dated Oct. 1, 1974; Pittis, U.S. Pat. No. 3,826,191, dated July 30, 1974; Hansen, et al., U.S. Pat. No. 3,774,531, dated Nov. 27, 1973; Huntoon et al., U.S. Pat. No. 3,742,848, dated July 3, 1973; Bossi, U.S. Pat. No. 3,741,110, dated June 26, 1973; Picard, U.S. Pat. No. 3,724,371; dated Apr. 3, 1973; Niccolai, U.S. Pat. No. 3,719,139, dated Mar. 6, 1973; and Harrington, U.S. Pat. No. 3,665,852, dated May 30, 1972; however, none of said patents as well as other prior art patents known to us disclose an endless flexible print belt or character support utilizing a series of type carrying segments in endless array, with the characters and timing marks provided on each of the segments, and with the segments being held together in a close side by side relationship by reinforcing cords and by an elastic encapsulating or bonding material which will permit the belt or band to flex as it moves around a pulley of any size including a small diameter pulley.

SUMMARY OF THE INVENTION

The present invention is directed to an improved character support and to a flexible print belt of an endless variety for both low, medium and high speed printers, with the print belt having a plurality of type bearing segments locked in position by means of an elastic encapsulation and cords in such a manner as to result in an endless print belt having excellent flexibility, trackability, printability and improved dampening qualities, thereby extending the life of the belt and of the characters thereon.

With such a construction, a plurality of elongated relatively hard type bearing segments of generally cylindrical configuration are located in a predetermined side-by-side relationship throughout 360° and in close proximity to adjacent segments, with the axis of the segments parallel. Each segment has a type character area thereon as well as its own timing mark. A series of reinforcing cords extend completely around, abut and connect the segments together. An elastic bonding or encapsulating material is disposed between the segments and around the cord to maintain the predetermined relationship between the segments. The elastic bonding material permits the belt to flex when in use on a pulley of any size thereby eliminating the fatigue problem of the prior art as explained previously. Thus pulleys substantially smaller than 5 inch outside diameter are now possible.

It is a feature of the present invention to provide a flexible endless belt of the aforementioned type which is adapted to be used on relatively small diameter wheels or pulleys of less than 5 inches.

Another feature of the present invention is to provide an endless flexible print belt of the aforementioned type which because of its flexible qualities and design, will not result in excessive heat being generated when in use or result in belt fatigue which is common with the prior art metallic belts.

Still another feature of the present invention is to provide an endless print belt of the aforementioned type wherein the reinforcing cords maintain the individual character segments in a compression and tension situation and further holds the center line of each character on a constant center line dimension of the belt.

A further feature of the present invention is to provide an endless flexible print belt of the aforementioned type wherein the segments or carriers are encapsulated or bonded in a plastic material as an example, urethane, which, as a result of the physical characteristics of the material utilized, causes the segments to track quietly; maintain the center line and the length of the belt; and also maintain the predetermined relationship between characters of adjacent segments.

A still further feature of the present invention is to provide an endless flexible print belt of the aforementioned type wherein the segments, carriers or pins are economically made from a hard material having a Rockwell measurement from $R_c$ 58 to 62, as an example, steel, carbide, plastic or steel alloys, thus permitting the life of the characters and timing marks provided on the segments to be substantially increased over the prior art. Each segment may have its own timing mark which will permit proper firing of the hammer in the hammer bank assembly of the printing apparatus.

A still further feature of the present invention is to provide an endless flexible print belt of the aforementioned type which has a very low profile along with a very close center distance of character to character permitted as a result of utilizing elongated relatively small and uniform segments.

A still further feature of the present invention is to provide an endless flexible print belt of the aforementioned type wherein the center of gravity of the belt is at the center of the pins.

Another feature of the present invention is to provide a print belt of the aforementioned type which has a low or small moment of inertia with the results that the belt tends to print and track in a very harmonic manner thus eliminating excessive vibrations.

Another feature of the present invention is to provide an endless flexible print belt of the aforementioned type made up of a plurality of relatively small diameter segments in an endless array, with the inner surface of the belt being smooth and with the edges or end faces of the segments on each side of the belt occupying parallel planes so as to provide a parallel and desirable finish upon which to guide and impact thereby having a smaller coefficient of friction than the prior art metallic belts which have a relatively high coefficient of friction.

Still another feature of the present invention is to provide a print belt of the aforementioned type that has an excellent ratio of weight to speed or "flywheel" that results in a belt with smooth running qualities.

A still further feature of the present invention is to provide a print belt of the aforementioned type wherein the plastic bonding material utilized has a muting or dampening effect on sound thereby permitting the belt to be operated at low decibels due to the deadening or dampening effect of the plastic material.

A further feature of the present invention is to provide an improved flexible endless print belt which eliminates, reduces or minimizes the problems of the prior art stated previously, thus providing a print belt having longer life and which is technically sound, easy to assemble and economical to manufacture.

BRIEF DESCRIPTION OF THE DRAWINGS

FIG. 1 is a front elevational view in diagrammatic form of a printing apparatus, illustrating an endless flexible print belt constructed according to the present invention mounted around a pair of pulleys forming part of the printing apparatus.

FIG. 2 is a pictorial view of one form of individual type segment, carrier or pin prior to encapsulation in a print belt and the formation of the character and timing mark thereon.

FIG. 3 is a sectional view taken on the line 3—3 of FIG. 2.

FIG. 4 is a fragmentary plan view of the print belt illustrated in FIG. 1, and looking in the direction of arrows 4—4 thereof.

FIG. 5 is a fragmentary side view of the print belt looking in the direction of arrows 5—5 of FIG. 4.

FIG. 6 is a sectional view through one segment of the print belt illustrated in FIG. 5 and taken on the line 6—6 thereof.

FIG. 7 is a sectional view through a portion of the print belt taken on the line 7—7 of FIG. 4 and showing the relationship of the cords with the segments.

FIG. 8 is a sectional view through a portion of the print belt taken on the line 8—8 of FIG. 4 and showing the flats and the type character areas on adjacent segments.

FIG. 9 is a plan view of a modified segment and illustrating the arrangement of the cords, character and timing mark.

FIG. 10 is a side elevational view of the modified segment looking in the direction of arrows 10—10 of FIG. 9.

FIG. 11 is a sectional view taken on the line 11—11 of FIG. 9 and illustrating the arcuate configuration of the eccentric section of the individual type segment with the encapsulated cord which enhance the qualities of flexibility in the finished belt.

FIG. 12 is a plan view of still another modified segment which is reversible, with the segment being provided with two sets of separate fonts or characters and timing marks.

FIG. 13 is a sectional view taken on the line 13—13 of FIG. 12, showing an eccentric section and with the cords being illustrated on the center line of the pin.

FIG. 14 is a plan view of another modified print belt segment showing the character on one end of the segment and the timing mark on the other end thereof whereby paper is presented to the end of such segment(s) instead of to the side of a segment(s) as shown in the other embodiments of FIGS. 4–8, 10 and 13.

FIG. 15 is an end view of the segment shown in FIG. 14 and illustrating the character thereon.

FIG. 16 is an end view of the segment shown in FIG. 14 and illustrating the timing mark thereon.

FIG. 17 is a sectional view taken on the line 17—17 of FIG. 14 and showing the relationship between the eccentric section and the cords.

FIG. 18 is a sectional view through a modified segment similar to FIG. 14 but showing the cords off center, with the tie pin or section being concentric and on center.

DESCRIPTION OF THE PREFERRED EMBODIMENTS

Referring now to the drawings, FIG. 1 illustrates a printing apparatus 10 comprising a pair of longitudinally spaced apart shafts 12 and 14 upon which are mounted pulleys 16 and 18 respectively. A flexible endless printing belt or character support 20, to be described subsequently, is trained in a circuitous path in a vertical plane about the pulleys 16 and 18. Conventional means including a motor 24 are provided for driving the shaft 12 and in turn the pulley 16 thereby moving or driving the belt 20 for presenting type characters to a print station as is well known in the art.

The prior art is replete with various printing apparatuses with which the belt or support 20 may be utilized including low, medium and high speed printers, on-the-fly printers, and other apparatuses shown by the U.S. patents identified in the Background of the Invention.

The flexible endless print belt or character support 20 comprises three constituents including type carrying segments, pins or carriers 26; a series of reinforcing cords 28; and an elastic bonding or encapsulating material or agent 30 which together with the cords 28 lock the segment in a predetermined position.

The segments, pins or carriers 26 utilized in any belt 20 are of identical construction except perhaps for the fonts or characters and timing marks. The present invention discloses a number of modified segments, pins or carriers of different designs (FIGS. 9–18 inclusive) which will be described subsequently.

FIG. 2 illustrates one segment 26 of generally cylindrical elongated form having an axis 28. The segment 26 is notched at two longitudinally spaced areas through approximately 180° (FIG. 3) to provide a pair of grooves 32. The portions 34 and 36 of the segment 26 on opposite ends of the grooves 32 as well as the intermediate portions 38 are initially of cylindrical form as clearly shown in FIG. 2.

A plurality of elongated segments 26 in an endless array are arranged in side by side relationship in close proximity to one another as shown in FIG. 1. The segments may abut as shown or be spaced slightly apart. The axes 28 of the segments 26 are parallel at all times as the belt 20 traverses the pulleys 16 and 18. The segments 26 are made from relatively hard material such as steel, carbide, plastic or a steel alloy. The material selected for the segments, for most applications, has a Rockwell measurement between $R_c$ 58 and 62.

The segments 26, as an example, may have an outside diameter of 0.1125; 0.125; or 0.1335 inches; and a length approximately ⅛ inch or longer to form an endless belt having a constant and uniform width suitable for use with existing equipment. The belts 20 when formed may have a length, as an example, 4 feet for some applications. Belts 20 when formed may vary in length.

The belt 20 constructed according to the present invention, regardless of its length, can track around smaller diameter pulleys than possible with the present state of the art. As an example, pulleys as small as ¾ inch may be used with the belts of the present invention. Thus equipment utilizing smaller heads and cabinets and overall space are achieved resulting in substantial economic advantages.

After the grooves 30 of the segments 26 are aligned in an endless array, a series of reinforcing cords 28 are inserted into the two series of aligned grooves 30. The cords 28 are divided into two sets 40 and 42, with each set having a plurality of continuous or endless cords 44 as shown in FIG. 4, which extend entirely around and abut the endless segments 26. The ends of each cord 44 are secured together. The cords 44 may take the form of a wire or strand made from metal, plastic, fiberglass, nylon, fabric, cotton or other suitable material or fabrication having sufficient strength to prevent stretching of the belt 20 longitudinally but accommodating movement of the belt 20, if any is required, as it moves around the pulleys 16 and 18 without substantial lateral or circumferential shift in the relative positions of the segments 26. In most cases, the belt 20 does not expand as it traverses the pulleys 16 and 18. The cords 44 maintain the segments 26 in a compression-tension situation at a constant center line dimension to insure continuous uniform spacing of the characters 46 provided on the segments 26. With such a construction the center of gravity of the belt is low and is located at the centers of the pins or segments 26 because of the symmetrical construction of the belt 20 and the even distribution of the mass. By using the relatively small cylindrical shaped segments 26, the pitch of the characters 46 can be much closer than in prior art devices.

once the sets of cords 40 and 42 are placed in the grooves 32 around the endless array of segments 26, a suitable elastic bonding or encapsulating agent or material 30 binds the segments 26 and cords 44 together as a unit. The elastic material 30 utilized may be a suitable elastomeric material such as plastic, rubber or any elastomeric material including vinyl and urethane to name a few. The elastic material 30, as shown in FIGS. 7 and 8, does not enclose or encompass all portions of the segments 26. The upper and lower elongated portions 50 and 52 as well as the end faces 54 of each segment 26 are not encapsulated or covered with the elastic bonding material 30. The cords 44 are entirely covered and embedded by the elastic bonding material 30 as shown in FIGS. 4, 6 and 7.

As noted in FIGS. 4–8, inclusive, each segment 26 is provided with generally flat parallel areas on the exposed upper and lower elongated portions 50 and 52. The printing or upper side of the segments 26, as shown in FIG. 4, has the flat area divided into three longitudinally spaced zones 56, 58 and 60. The center zone 58 forms the type character area for the character or font 46. Such fonts 46 may be placed on the flat zone or area 58 by conventional means, as an example, by mechanical, chemical or electrical generation or by welding, gluing or mechanical bonding well known in the art. The fonts or characters 46 are hardened and have a Rockwell measurement between $R_c$ 58 to 62 thereby insuring long life and minimizing the wear problem caused by paper on soft metal which occurs in the prior art metallic belts mentioned previously. The center line of the character is maintained constant.

A timing mark is carried by each segment 26, as an example, on the flat zone 56 as shown in FIGS. 4 and 6. The timing marks 12, applied in a conventional manner, are also hardened and have a Rockwell measurement like the fonts 46 described previously.

The elastic material 30 does not contact the flat guide or platen surfaces 66 provided on the lower elongated portions 52 of the segments 26; or does it contact the fonts 46 and timing marks 62 thereof. The parallel areas provided on the upper and lower portions 50 and 52 of segments 26 are ground flat and parallel. The segments 26 also have certain magnetic qualities which help to hold down and guide the belt 20 about the pulleys 16 and 18.

The term character or font as used herein is defined as any letter, number, symbol or bar of any language or system.

The design and construction of the endless flexible belt 20 will allow tracking over small diameter pulleys, and can be used with variable center distances between drive pulleys.

As noted herein the construction of the segments 26 allows a low profile, which is desirable to maintain the position of the character to timing mark or device. The mass of the belt or band 20 allows the impact by the hammers on the characters to be absorbed within the resilient belt, without loss or belt speed due to impact.

As shown in FIG. 4 the character segments or carriers 26 are separated or spaced slightly apart within the belt 20 allowing the segments 26 to be used as a timing means.

Due to the flexible qualities of belt 20, little heat is generated. In addition, stresses are not introduced into it during use which will cause the belt to fail. The apparatus runs smoother when using belt 20 which has an outstanding ratio of weight to speed or flywheel effect at high velocities. The elastic material 30 of the belt has a muting effect or sound. In addition the print belt 20 has improved lubrication qualities over the prior art metallic belts.

FIGS. 9–11 shows a modified segment, carrier or pin 70 which is elongated and has an axis 72. The segment 70, originally in cylindrical form, includes a pair of spaced apart grooves 74 in which, after a plurality of segments 70 are aligned, are located the two sets of reinforcing cords 40, each set containing a plurality of cords 44. The cords 44 and segments 70 are adapted to be locked in place by the aforementioned elastic bonding material.

The segment 70 has a pair of eccentric sections or portions 76 against which the cords 44 abut, with the cords intersecting and being perpendicular to the axis of the segment 70. The eccentric sections 76, as shown in FIG. 12, include arcuate portion 77 to enhance the flexible qualities of the belt and to minimize cutting of the cords 44. The segment 70 includes three generally cylindrical like portions 78 which are spaced apart. The upper and lower elongated portions of the segment 70 are modified to provide flat surfaces 80 and 82. The font or character 46 and timing mark 62 are provided on the surfaces 80 as shown.

FIGS. 12 and 13 represent another modified elongated segment 84 having an axis 86. The segment 84 contains four spaced apart generally cylindrical portions 88 (FIG. 12) joined by the eccentric ties or elements 90 of generally circular cross section. An annular space or groove 92 generally surrounds each of the eccentric elements 90 and through which three sets of reinforcing cords 40 extend, each set containing a plurality of cords 44. The upper and lower elongated areas of segments 84 are flat like in the other embodiments, with the printing side having a pair of characters or fonts and a pair of timing marks 62. When an endless series of eccentric segments 84 are located in a print belt, the belt is reversible, with one font and timing mark on each eccentric segment 84 being used at any given time. The cords 44 abut the eccentric elements 90 and intersect and are perpendicular to the segment axis 86.

FIGS. 14–17 inclusive show another modified segment 94 having an axis 95 which is similar in construction to the embodiment of FIGS. 12 and 13 except for the location of the font and timing mark. It includes only a pair of eccentric ties or elements 96 and a pair of corresponding annular grooves 98 for the two sets of cords 40. Each cord 44 of both sets abuts the corresponding eccentric 96, and intersects and is perpendicular to the segment axis 95 as as shown in FIG. 17. The upper and lower elongated portions of the segment 94 are ground flat and parallel as in the embodiment of FIGS. 4–8. In segment 94, the font or character 46 is located on the generally flat end face 100 (FIG. 15), while the timing mark 62 is located on the other generally flat end face 102 (FIG. 16).

FIG. 18 shows a cross-sectional view of a modified segment 94′, with the pair of generally cylindrical ties or elements 96′ being concentric with the axis 95′ of the segment 94′. The cords 44 when arranged in the grooves abut the ties 96′ (FIG. 18) but are spaced from and eccentric to the segment axis 95′. The timing mark and character may be located on the elongated flat areas provided on the segment 94′ as in FIGS. 9–11 inclusive or on the end faces thereof is in FIGS. 14–17 inclusive.

All of the modified embodiments of FIGS. 9–18 inclusive may be assembled and encapsulated or bonded in the manner disclosed for FIGS. 1–8 inclusive, thus achieving many of the same advantages.

The endless print belt when formed may also be affixed and secured to an elongated cylindrical drum and used with drum printers; and it may also be affixed and secured to a wheel of generally circular cross section and used as a print wheel with wheel printers. When used in a drum or wheel, the endless belt will not be flexible and thus whatever bonding material is utilized between the adjacent endless segments will not have to be elastic.

What is claimed is:

1. A character support for use in a printing apparatus comprising a plurality of generally cylindrical elongated segments each having a longitudinal axis and at least two grooves substantially normal to said axis, said elongated segments being arranged in a predetermined side by side relationship and in close proximity to one another with the axes of said segments being parallel and said grooves aligned, each segment having a type character area, and said support including bonding means disposed within said grooves and between said segments for maintaining said predetermined relationship between said segments.

2. The character support defined in claim 1 wherein said bonding means includes at least one cord disposed in each of said aligned grooves, each said at least one cord extending laterally across said segments to provide reinforcement for the support and encapsulating means covering said at least one cord and the portions of said segments adjacent thereto for maintaining said predetermined relationship.

3. The character support defined in claim 1, wherein said at least two aligned grooves are spaced from one another along said segment axis and wherein said bonding means includes at least two sets of cords, one set of cords being disposed in each of said aligned grooves, the individual cords of each of said sets of cords being parallel to one another and wherein said bonding means further includes encapsulating means for covering said at least two sets of cords for maintaining said predetermined relationship, said encapsulating means including an elastic material which permits said support to flex.

4. The character support of claim 1 wherein each of said segments has opposing pairs of flat surfaces on opposite sides thereof the plane of said surfaces being parallel to the axis of said segment, and wherein said flat-surfaces on either of said opposite sides are spacially separated along said axis by said encapsulated sets of cords, at least one of said flat surfaces having said type character area thereon.

5. An endless flexible print belt for a printer comprising a plurality of generally cylindrical elongated segments each having a longitudinal axis, said segments being located in a predetermined side by side relationship to form a closed loop and in close proximity to adjacent segments, with the axes of said segments being parallel, each segment having a type character area thereon and at least two grooves spaced along said axis, said at least two grooves being aligned with each other, said belt further including a series of reinforcing cords disposed in said grooves and extending completely around said at least two aligned grooves of said looped segments for abutting and connecting said segments, and an elastic bonding material disposed between said segments and around said cords to maintain the predetermined relationship between said segments, said elastic bonding material permitting said belt to flex when in use.

6. The endless flexible print belt defined in claim 5 wherein said segments are made from steel.

7. The endless flexible print belt defined in claim 5 wherein each of said segments has opposing flat surfaces on opposite sides thereof the plane of said surfaces being parallel to said axis of said segment, said type character area being on one of said flat surfaces.

8. The endless flexible print belt defined in claim 7 wherein at least one of said surfaces is located midway between the longitudinal ends of the corresponding segment and between said grooves.

9. The endless flexible print belt defined in claim 7 wherein said series of cords are arranged in at least two sets, one set disposed in each groove and wherein each set comprises a plurality of substantially parallel cords.

10. The endless flexible print belt of claim 9, wherein at least one of said opposing flat surfaces is disposed between said at least two sets of cords and wherein said type character area is on said at least one opposing flat surface.

11. The endless flexible print belt of claim 7, wherein each segment has a first and a second character area thereon, the character areas being located on said opposing flat surfaces on opposite sides of said one of said at least two grooves.

12. The endless flexible print belt defined in claim 11 wherein each of said segments is provided with a timing mark on one of said flat surfaces spaced from said type character area.

13. The endless flexible print belt defined in claim 5 wherein each of said segments has substantially flat end faces at opposite longitudinal ends thereof and wherein said type character area is located on at least one end face of the segment.

* * * * *